US008533980B2

(12) United States Patent
Elbaz et al.

(10) Patent No.: US 8,533,980 B2
(45) Date of Patent: Sep. 17, 2013

(54) MAP FOR FOOTWEAR

(75) Inventors: Avi Elbaz, Dimona (IL); Amit Mor, Rehovot (IL)

(73) Assignee: APOS—Medical and Sports Technologies Ltd., Herzeliya (IL)

( * ) Notice: Subject to any disclaimer, the term of this patent is extended or adjusted under 35 U.S.C. 154(b) by 857 days.

(21) Appl. No.: 12/202,270

(22) Filed: Aug. 31, 2008

(65) Prior Publication Data

US 2010/0050476 A1 Mar. 4, 2010

(51) Int. Cl.
*A43B 13/12* (2006.01)

(52) U.S. Cl.
USPC ..... 36/103; 36/25 R; 36/36 R; 36/132; 36/15; 36/160

(58) Field of Classification Search
USPC ..... 36/160–163, 59 C, 15, 114, 132, 36/134, 136, 103, 36 R, 36 A, 36 B, 36 C, 36/62, 64–66
See application file for complete search history.

(56) References Cited

U.S. PATENT DOCUMENTS

| | | | | | |
|---|---|---|---|---|---|
| 1,061,353 | A * | 5/1913 | Block | 36/163 |
| 2,133,302 | A * | 10/1938 | McCormick | 36/162 |
| 2,311,925 | A * | 2/1943 | Boos | 36/163 |
| 2,518,033 | A * | 8/1950 | Wilbert | 36/163 |
| 4,841,648 | A * | 6/1989 | Shaffer et al. | 36/43 |
| 5,400,528 | A * | 3/1995 | Skinner et al. | 36/161 |
| 6,349,487 | B1 * | 2/2002 | Hice | 36/140 |
| 6,742,289 | B2 * | 6/2004 | Celmo | 36/141 |
| 6,792,703 | B2 * | 9/2004 | Cohen | 36/136 |
| 7,373,740 | B2 * | 5/2008 | Lo | 36/44 |
| 7,500,324 | B1 * | 3/2009 | Power et al. | 36/132 |
| 2002/0166258 | A1 * | 11/2002 | Posa | 36/11.5 |
| 2005/0235526 | A1 * | 10/2005 | Kim | 36/91 |
| 2007/0051020 | A1 * | 3/2007 | Tajima et al. | 36/132 |
| 2007/0079532 | A1 * | 4/2007 | Ramirez | 36/140 |

* cited by examiner

*Primary Examiner* — Khoa Huynh
*Assistant Examiner* — Katharine Gracz
(74) *Attorney, Agent, or Firm* — Rodney J. Fuller; Booth Udall Fuller, PLC

(57) ABSTRACT

A footwear assembly including footwear composed of (a) an upper surface adapted to a foot, (b) two protuberances, (c) a sole, and (d) a map formed on the sole. The map includes markings that define an orientation and position for mounting two protuberances on a bottom surface of the sole.

9 Claims, 4 Drawing Sheets

MAP FOR FOOTWEAR

FIELD OF THE INVENTION

The present invention relates generally to footwear for training, developing and enhancing proprioceptive and kinesthetic skills and neuromuscular control, and particularly to a map formed on a sole of footwear.

BACKGROUND OF THE INVENTION

Proprioception refers to the ability to know where a body part is located in space and to recognize movements of body parts (such as fingers and toes, feet and hands, legs and arms). Kinesthesia is a related term, and refers to the sensation by which position, weight, muscle tension and movement are perceived. In some of the medical literature, proprioception refers to the conscious and unconscious appreciation of joint position, while kinesthesia refers to the sensation of joint velocity and acceleration. Proprioception is often used interchangeably with kinesthesia, and herein as well, the terms will be used interchangeably.

U.S. Pat. No. 6,979,287 to Elbaz and Mor describes novel proprioceptive and kinesthetic exercise apparatus, which provides significant advantages over other prior art apparatus, such as tilt boards or shoes with a single protrusion. The apparatus includes two bulbous protrusions protruding from the underside of footwear, instead of the single ball of the prior art boards and shoes. One of the protuberances is positioned more posteriorly than the other protuberance. The extra protrusion may significantly increase the possibilities and enable walking, and accelerate and improve the results of proprioceptive and kinesthetic treatment plans.

SUMMARY OF THE INVENTION

The present invention seeks to provide further features to U.S. Pat. No. 6,979,287, the disclosure of which is incorporated herein by reference. As is described more in detail hereinbelow, in the present invention improved mounting provisions are provided for the proprioceptive (biomechanical) elements that includes a map for unique and easy mounting of the elements on the footwear.

There is thus provided in accordance with an embodiment of the present invention a footwear assembly including footwear including a sole and a map formed on the sole, and at least one proprioceptive element mountable on the sole, the map and the at least one proprioceptive element each including markings, wherein an alignment of the markings of the at least one proprioceptive element with the markings of the map uniquely defines an orientation and position of the at least one proprioceptive element with respect to the sole. Typically, the footwear assembly includes a pair of such proprioceptive elements, one positioned more posteriorly than the other.

In accordance with an embodiment of the present invention the markings of the map include an orderly set of hexagons, and each hexagon is sub-divided into six triangles. Each hexagon may be marked with a number and each triangle of the hexagon may be numbered (but not necessarily marked).

In accordance with an embodiment of the present invention the markings of the proprioceptive element include four markings spaced 90° apart.

BRIEF DESCRIPTION OF THE DRAWINGS

The present invention will be understood and appreciated more fully from the following detailed description taken in conjunction with the appended drawings in which.

DETAILED DESCRIPTION OF THE PRESENT INVENTION

Figure 1:
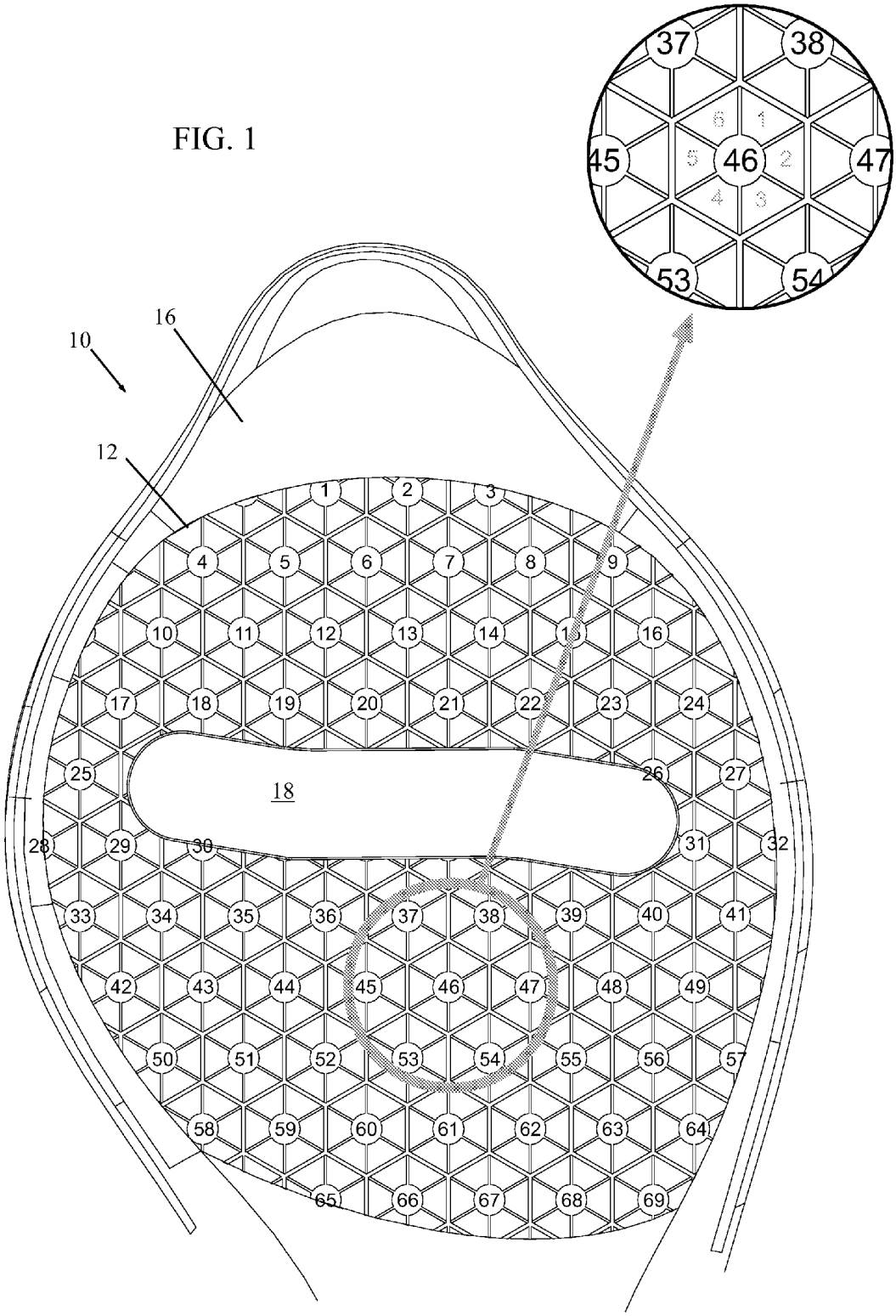
FIG. 1 is a simplified pictorial illustration of footwear having a map for unique orientation of a proprioceptive element mounted thereto, constructed and operative in accordance with an embodiment of the present invention.

As mentioned above, U.S. Pat. No. 6,979,287 describes novel proprioceptive and kinesthetic exercise apparatus, which includes two bulbous protrusions protruding from the underside of footwear. One of the protuberances is positioned more posteriorly than the other protuberance. These bulbous protrusions are also referred to as proprioceptive elements.

Footwear 10 preferably comprises a support member having a periphery in a shape of a shoe sole with an upper surface 44. In the illustrated embodiment, the upper surface 44 is indented with a peripheral ridge, but it is appreciated that other configurations of upper surface 44 are within the scope of the invention. Footwear 10 may be attached to a foot of a user (not shown) by means of a boot 48 and/or fasteners 50, such as but not limited to, VELCRO straps, buckles, shoe laces, and the like. Boot 48 may be fashioned for attachment to the user's foot with or without fasteners 50. Similarly, fasteners 50 may be used to attach footwear to the user's foot without boot 48.

Two bulbous protuberances 52 may protrude from a lower surface 54 of support member 42. Each protuberance 52 may have a curved outer contour 56. The cross-section of the contour 56, that is, either the cross-section taken with respect to a longitudinal axis 58 (FIG. 6) of support member 42 (corresponding to the shape seen in FIG. 6) or the cross-section taken with respect to a latitudinal axis 60 (FIG. 6) of support member 42 (corresponding to the shape seen in FIG. 5), or any other cross-section, may have any curvilinear shape. For example, the contours 56 may have the shape of a conic section, that is, the shape of a circle, ellipse, parabola or hyperbola. The various cross-sections of the contours 56 of protuberance 52 may be shaped identically or differently.

Figure 4:
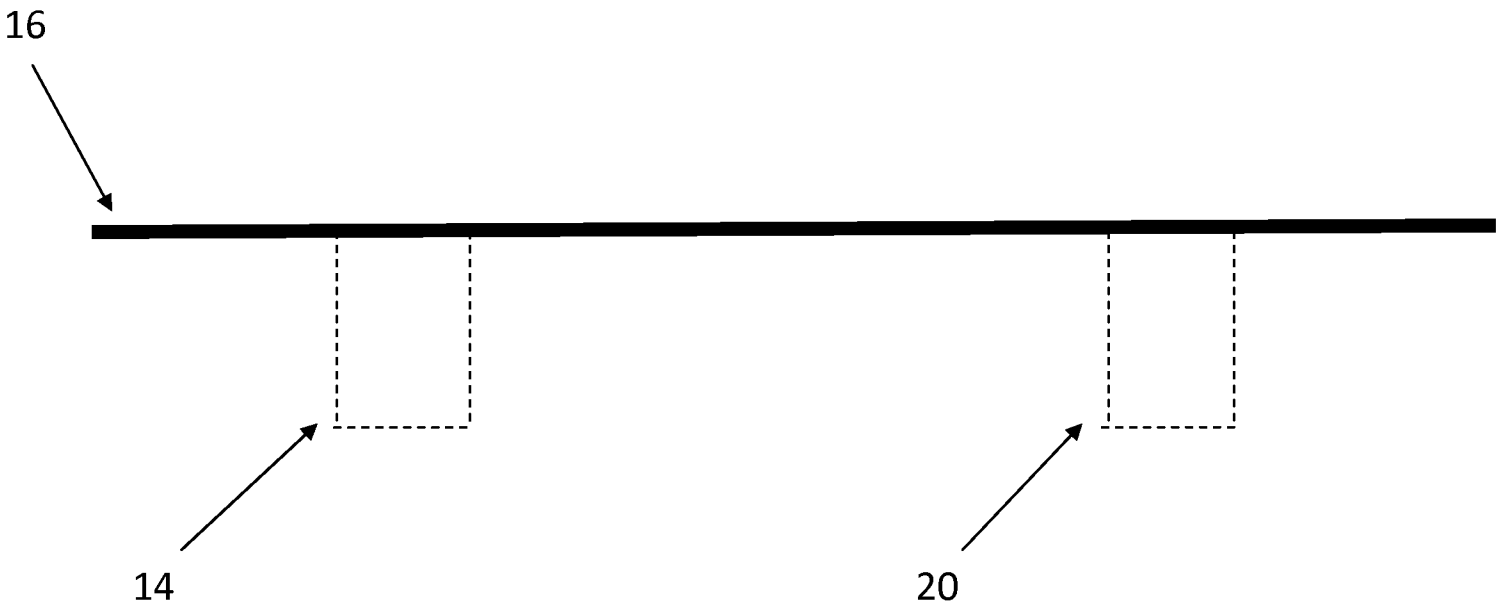
FIG. 4 is a simplified pictorial illustration of a cross sectional view of footwear including a sole and representative proprioceptive elements protruding from the sole.

As seen clearly in FIG. 4, one protuberance 52 may be positioned more posteriorly than the other protuberance 52. As seen in FIG. 6, the protuberances may be positioned on a common longitudinal axis of support member 42, such_as the centerline 58 of support member 42, and on opposite sides of the latitudinal midline 60. As seen in FIG. 4, the rearward protuberance 52 may be positioned generally underneath a calcaneus (heel, ankle) support portion 53 of support member 42, while the forward protuberance 52 may be positioned generally underneath a metatarsals support portion 55 and/or phalanges support portion 57 of support member 42.

Alternatively, as indicated by broken lines 63 in FIG. 6, one of the protuberances 52 (e.g., the forward one) may be aligned on a longitudinal axis 64 offset from centerline 58, and the rearward protuberance 52 may be positioned offset from axis 64, such as on the centerline 58. It is appreciated that the above are just some examples of positioning the protuberances 52, and many other possibilities exist within the scope of the invention.

The protuberances 52 may be constructed of any suitable material, such as but not limited to, elastomers or metal or a combination of materials, and may have different properties. For example, the protuberances may have different resilience or hardness, such as having different elasticity properties or Shore hardness. The protuberances 52 may protrude by different amounts from the lower surface 54 of support member 42.

Figure 2:
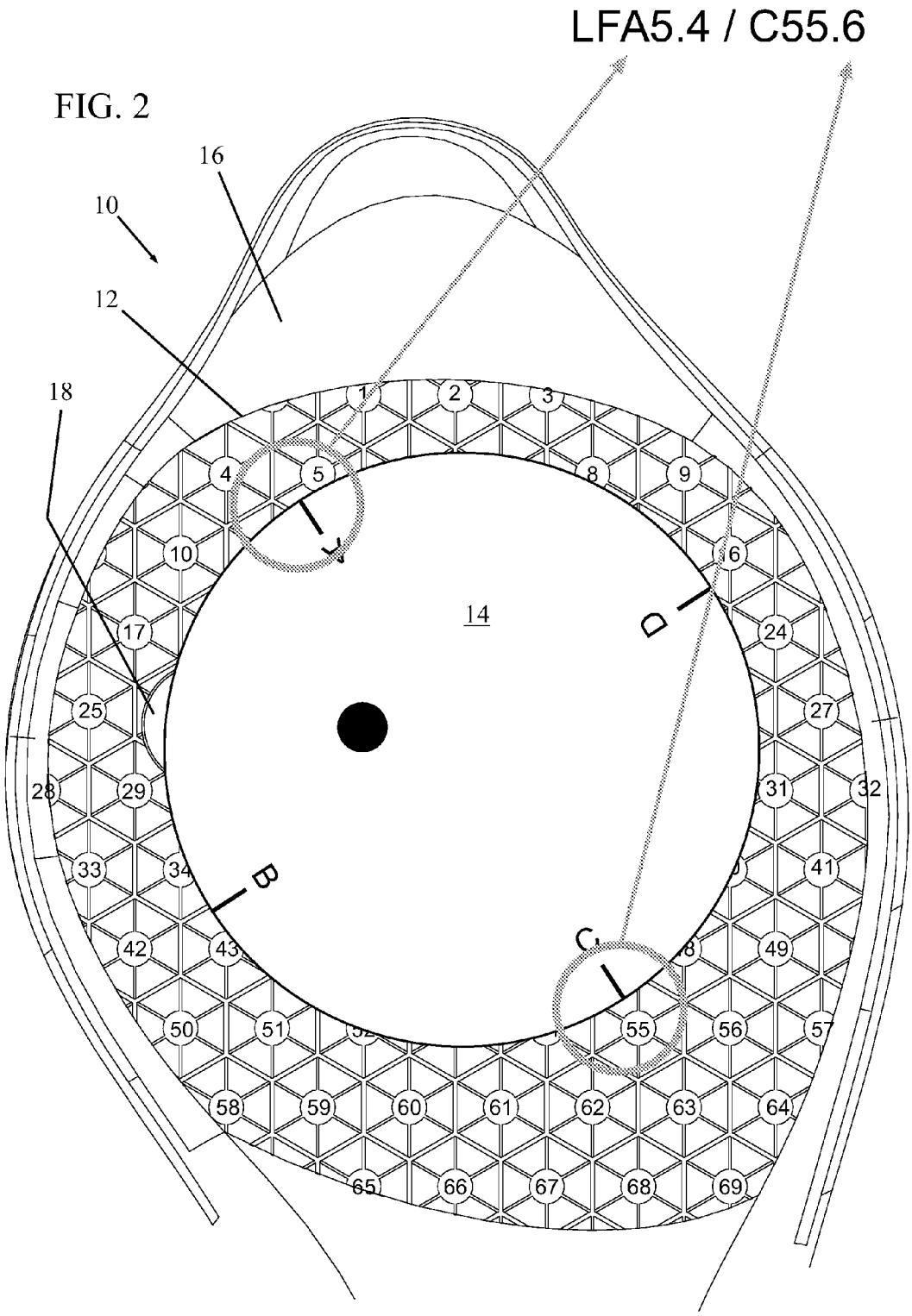
FIG. 2 is a simplified pictorial illustration of a first proprioceptive element mounted on the footwear of FIG. 1, showing the first position code that defines the orientation of the first proprioceptive element mounted on the footwear.

Reference is now made to FIGS. 1 and 2, which illustrate footwear 10 having a map 12 for unique orientation of a first proprioceptive element 14 mounted thereto, constructed and operative in accordance with an embodiment of the present invention.

The footwear 10 has a sole 16 upon which map 12 is formed. Map 12 may be formed in a variety of manners, such as but not limited to, by printing, stamping, embossing on sole 16, or may be injection molded together with the sole 16. Map 12 comprises markings and first proprioceptive element 14 comprises markings. When the markings of first proprioceptive element 14 are aligned with the markings of sole map 12, the orientation and position of first proprioceptive element 14 with respect to the sole 16 is uniquely defined.

The map markings may include an orderly set of coordinates (e.g., Cartesian, polar and others). In the non-limiting illustrated embodiment, the map markings comprise an orderly set of hexagons, each hexagon being sub-divided into six triangles. Each hexagon is marked with a number (such as from 1-69) and each triangle of the hexagon is numbered (but the triangles are not necessarily marked with the numbers), such as from 1-6, triangle number 1 being at an upper right portion of the hexagon, triangle number 2 being at a right portion of the hexagon, triangle number 3 being at a lower right portion of the hexagon, triangle number 4 being at a lower left portion of the hexagon, triangle number 5 being at a left portion of the hexagon, and triangle number 6 being at an upper left portion of the hexagon.

In accordance with an embodiment of the present invention, one or more protuberances 52 may be slidingly mounted on support member 42. For example, protuberance 52 may be mounted on a track 66 (FIG. 4) formed in the lower surface 54 of support member 42, and may be selectively positioned anywhere along the track and fastened thereto. Track 66 may extend along a portion of the shoe sole or all along the length of the shoe sole. Alternatively or additionally, the amount of protrusion of protuberance 52 may be adjusted, such as by mounting protuberance 52 with a threaded fastener 68 (FIG. 5) to support member 42 and tightening or releasing threaded fastener 68.

Figure 3:
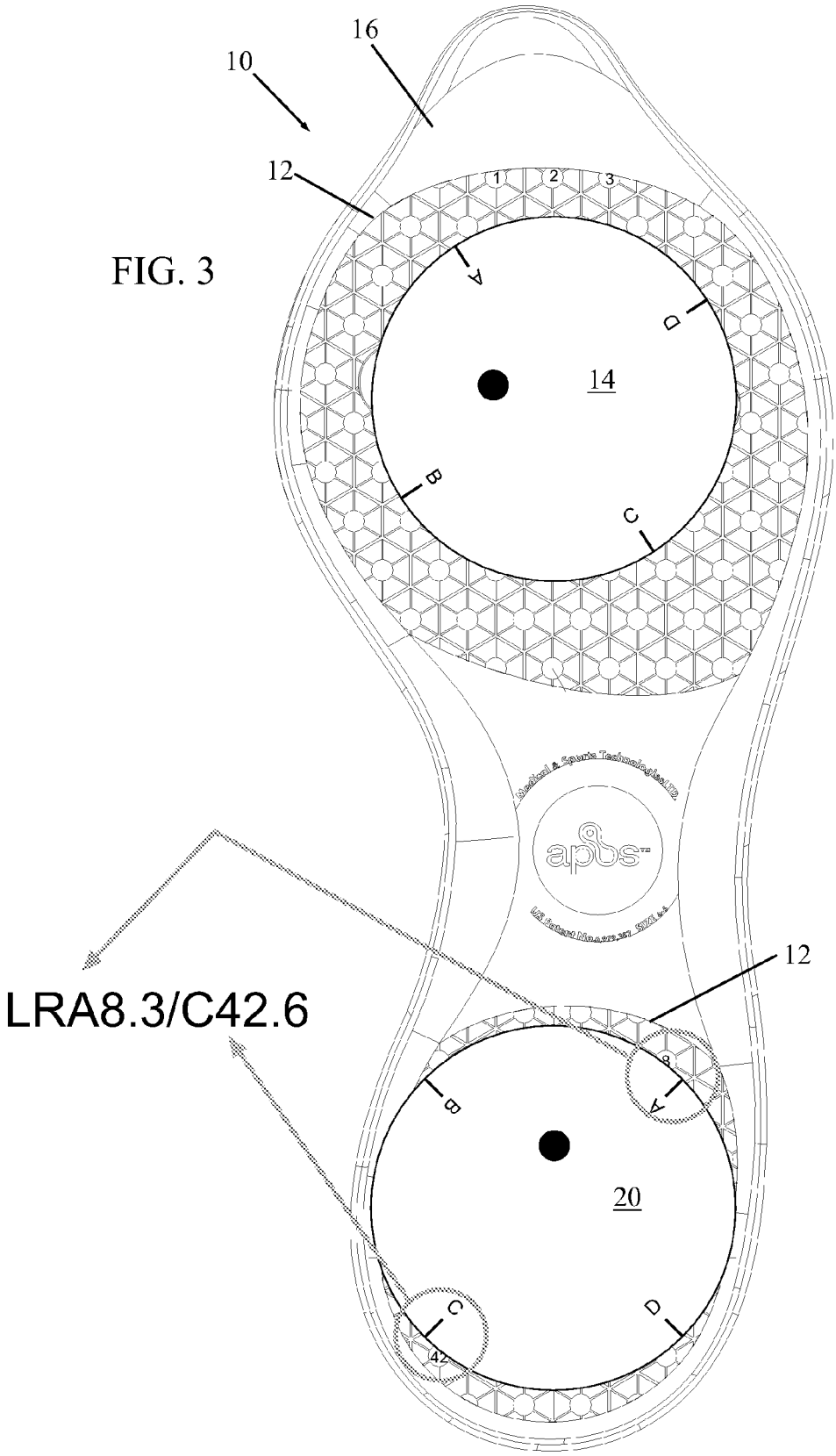
FIG. 3 is a simplified pictorial illustration of a second proprioceptive element mounted on the footwear of FIG. 1, showing the second position code that defines the orientation of the second proprioceptive element mounted on the footwear.

As described in U.S. Pat. No. 6,979,287, the proprioceptive element is movably mounted along a track 18 formed in the bottom of sole 16. In the present application, first proprioceptive element 14, as seen in FIG. 2, comprises markings such as A, B, C and D, spaced 90° apart. First proprioceptive element 14 is secured to track 18 (by a mechanical fastener, such as a screw, not shown). The A marking is aligned with triangle number 4 of hexagon number 5 and the C marking is aligned with triangle number 6 of hexagon number 55. This uniquely defines the orientation and position of first proprioceptive element 14 with respect to sole 16. Since the footwear shown in FIGS. 1-3 is the left shoe, the first position code that defines the orientation of the first proprioceptive element 14 mounted on the footwear 10 is LFA5.4/C55.6. L stands for "left shoe", F stands for the front (first) proprioceptive element, A is the A marking of first proprioceptive element 14, 5.4 stands for hexagon 5, triangle 4, C is the C marking of first proprioceptive element 14, and 55.6 stands for hexagon 55, triangle 6.

Reference is now made to FIG. 3, which illustrates a second proprioceptive element 20 mounted on footwear 10. In this example, the second position code that defines the orientation of second proprioceptive element 20 is LRA8.3/C42.6. L stands for "left shoe", R stands for the rear (second) proprioceptive element, A is the A marking of second proprioceptive element 20, 8.3 stands for hexagon 8, triangle 3, C is the C marking of second proprioceptive element 20, and 42.6 stands for hexagon 42, triangle 6.

The complete position code for this exemplary, non-limiting shoe is thus LFA5.4/C55.6 LRA8.3/C42.6.

Other polygons, shapes and sub-divisions can be used for the map.

It will be appreciated by persons skilled in the art that the present invention is not limited by what has been particularly shown and described hereinabove. Rather the scope of the present invention includes both combinations and subcombinations of the features described hereinabove as well as modifications and variations thereof which would occur to a person of skill in the art upon reading the foregoing description and which are not in the prior art.

What is claimed is:

1. A footwear comprising:

(a) an upper surface adapted to attach to a foot;

(b) a sole comprising a map and at least two tracks formed on a bottom surface of the sole wherein said bottom surface is adapted to contact the ground where the footwear is being worn by a user; and (c) two bulbous protuberances comprising at least one orientation marking, wherein at least one bulbous protuberance is mounted along the track and the two bulbous protuberances protrude outward from an underside of the footwear, wherein the map comprises a set of orderly coordinates comprising a set of numbered markings, the set of orderly coordinates on the sole and the at least one orientation marking on each bulbous protuberance form position codes that define an orientation and position of each bulbous protuberance with respect to the bottom surface of the sole of the footwear;

wherein the numbered markings of the set of orderly coordinates of the map comprise an orderly set of hexagons which are sub-divided into six triangles; wherein each hexagon is marked with a number and each triangle of the hexagon is numbered.

2. The footwear according to claim 1, wherein the footwear is configured to support the foot only by the two bulbous protuberances when the two protuberances are placed on a ground surface.

3. The footwear according to claim 1, wherein a rearward bulbous protuberance is mounted generally underneath a calcaneous support portion of the sole.

4. The footwear according to claim 1, wherein a forward bulbous protuberance is mounted generally underneath a metatarsals support portion of the sole.

5. The footwear according to claim 1, wherein the markings of the bulbous protuberances comprises four orientation markings spaced 90° apart.

6. A footwear comprising:

an upper surface adapted to attach to a foot;

a sole having a bottom surface, the sole comprising a map and at least two tracks on the bottom surface of the sole; and at least one proprioceptive element mounted along one of said at least two tracks and protruding out from an underside of the footwear, the at least one proprioceptive element comprising an orientation marking, wherein the map comprises a set of orderly coordinates comprising a set of map markings, the set of orderly coordinates and the orientation marking on the at least one proprioceptive element forming a position code that defines an orientation and position of the at least one proprioceptive element with respect to the bottom surface of the sole, wherein the map markings are numbered markings of the set of orderly coordinates of the map comprise an orderly set of hexagons which are sub-divided into six triangles arranged within a boundary formed by said set of hexagons; wherein each hexagon is marked with a number and each triangle of the hexagon is numbered.

7. The footwear of claim 6, further comprising a first position code that defines the orientation of a first proprioceptive element mounted on the bottom surface of the sole and a second position code that defines the orientation of a second proprioceptive element also mounted on bottom surface of the sole.

8. The footwear element of claim 6, wherein each proprioceptive element has four orientation markings.

9. A footwear assembly comprising:

a footwear comprising a sole having a bottom surface, the sole comprising a map and at least two tracks on a bottom surface of the sole, the map comprising a set of orderly coordinates comprising a set of markings; and at least one proprioceptive element mountable along a track of said at least two tracks formed on the sole and comprising an orientation marking, wherein the set of orderly coordinates on the map define an orientation and position for mounting the at least one proprioceptive element with respect to the sole, the set of orderly coordinates and the orientation marking on the at least one proprioceptive element form a position code that defines the orientation and position of the at least one proprioceptive element with respect to the bottom surface of the sole when the at least one proprioceptive element protrudes outwards from the underside of the footwear, wherein the map markings are numbered markings of the set of orderly coordinates of the map comprise an orderly set of hexagons which are sub-divided into six triangles; wherein each hexagon is marked with a number and each triangle of the hexagon is numbered.

* * * * *